US005678359A

United States Patent [19]

Turner

[11] Patent Number: 5,678,359

[45] Date of Patent: Oct. 21, 1997

[54] SLOPED GUTTER ASSEMBLY

[76] Inventor: Cyril Turner, 4978 Clubgreen Summit, Stone Mountain, Ga. 30088

[21] Appl. No.: 649,778

[22] Filed: May 17, 1996

[51] Int. Cl.[6] ..... E04D 13/064

[52] U.S. Cl. ..... 52/12; 52/11; 52/16; 52/105

[58] Field of Search ..... 52/11, 12, 16, 52/105

[56] References Cited

U.S. PATENT DOCUMENTS

| | | | |
|---|---|---|---|
| 956,372 | 4/1910 | Kreutzberg | 52/12 X |
| 3,420,378 | 1/1969 | Turner | 52/12 X |
| 3,834,091 | 9/1974 | Dugan | 52/12 |
| 4,032,456 | 6/1977 | Berce | 52/12 X |
| 4,036,761 | 7/1977 | Rankin | 52/12 X |
| 4,590,716 | 5/1986 | Smith | 52/11 X |
| 4,959,932 | 10/1990 | Pfeifer | 52/12 |
| 5,216,852 | 6/1993 | Bemis et al. | 52/11 X |

*Primary Examiner*—Christopher T. Kent
*Attorney, Agent, or Firm*—Richard D. Zimmerman

[57] ABSTRACT

A sloped gutter assembly provides for the controlled discharge of runoff water from a structure roof. The gutter assembly includes a first elongated gutter section having a bottom and upstanding side walls that collectively define a U-shaped cross-section. The first gutter section is characterized by an upstream end and a downstream end, wherein the side walls are tapered progressively from the upstream end to the downstream end. This taper defines a cross-section of progressively reduced dimension. A plurality of mounting brackets are spaced apart and integrally attached to one of the upstanding sidewalls, and attach the first elongated gutter section to the structure. Finally, the gutter assembly includes a screen that is hingedly attached along one side to the upstanding side wall disposed adjacent the structure. The screen is further disposed to overlie the opposing gutter side wall, and therefore the gutter channel. In this way, the screen serves to prevent leaves and other debris from entering or collecting within the gutter channel. Preferably, the screen is elevated on the hinged side to slope downwardly toward the opposing side. The gutter assembly further includes a downspout section that telescopically receives the downstream end of the first gutter section. A hole is disposed in the bottom of the downspout section for receiving a downspout.

18 Claims, 7 Drawing Sheets

SLOPED GUTTER ASSEMBLY

FIELD OF THE INVENTION

The present invention generally relates to gutter assemblies, and more particularly to a gutter assembly having a sloped bottom and an improved mechanism for preventing leaves and other foreign debris from collecting within the gutter channel.

DISCUSSION OF THE RELATED ART

As is known, the installation of a gutter system generally requires two persons working in concert to attach a gutter in a properly sloped fashion. While gutter systems are relatively simple in structure and operation, installation can nevertheless be relatively time consuming. For example, sloping a section of gutter channel involves a tradeoff between competing interests. On the one hand, a steeply sloped gutter channel desirably provides for rapid discharge of runoff water. On the other hand, it is desired to place the gutter as close as possible underneath the roof. Steeply sloping the gutter channel unduly displaces the downstream end of the gutter channel from the roof. Generally, the latter factor controls and additional time is spent during installation to carefully hang the gutter channels at a very slight grade. In addition, the installation process typically entails precise measurements for sizing the various gutter sections and components, in order to properly size them to fit the particular structure. The various cut sections, as well as end-caps, downspout openings, and other attachments are then connected.

Once the gutter installation is completed, a separate process is needed to install gutter screens. As is known, the screens overlie the top of the gutter channel to prevent leaves and other foreign debris from clogging the gutter channel, or otherwise inhibiting the free flow of roof runoff water through the gutter channel. While screens are generally effective to keep most foreign debris out of the gutter channel, leaves and other debris often collect on top of the screen and inhibit runoff water from entering the gutter channel, particularly during times of heavy runoff.

Another factor that adds to the cost of gutter installation is attributed to the added time required for installation resulting from the relatively high location of the gutter. Even gutter assemblies attached adjacent the roof of a single-story structure generally require two persons working on ladders or scaffolding to perform the installation. Working on ladders or scaffolding in this manner necessarily makes the task more cumbersome, and therefore time consuming. Accordingly, there is a great need for a gutter assembly that is more easily and efficiently installed.

SUMMARY OF THE INVENTION

Accordingly, a primary object of the present invention is to provide an improved gutter assembly that realizes more efficient installation than gutter assemblies in the prior art.

A more particular object of the present invention is to provide a gutter assembly that is capable of being installed by a single installer.

Another object of the present invention is to provide a gutter assembly that is more readily attached to a structure so as to dispose the gutter channel at a pre-determined slope to facilitate the channelling of discharge water.

Still another object of the present invention is to provide gutter assembly having an improved screen mechanism for preventing the collection of leaves and other debris within the gutter channel.

Another object of the present invention is to provide an improved gutter assembly having a structure that allows for much greater tolerance among dimension and measurement of the various component parts.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to a sloped gutter assembly providing for the controlled discharge of runoff water from a structure roof. The improved gutter assembly includes a first elongated gutter section having a bottom and upstanding side walls that collectively define a U-shaped cross-section. The first gutter section is characterized by an upstream end and a downstream end, wherein the side walls are tapered progressively from the upstream end to the downstream end. This taper defines a cross-section of progressively increased dimension. A plurality of mounting brackets are spaced apart and integrally attached to one of the upstanding sidewalls. The mounting brackets include means for attaching the first elongated gutter section to the structure, adjacent the roof. Finally, the gutter assembly includes a screen that is hingedly attached along one side to the upstanding side wall disposed adjacent the structure. The screen is further disposed to overlie the opposing gutter side wall, and therefore the gutter channel. In this way, the screen serves to prevent leaves and other debris from entering or collecting within the gutter channel. Preferably, the screen is elevated on the hinged side to slope downwardly toward the opposing side.

In accordance with one aspect of the invention, the gutter assembly further includes a downspout section being of generally U-shaped cross-section. The downspout section includes a first end that telescopically receives the downstream end of the first gutter section. A second, closed end is provided opposite the first end. A hole is disposed in the bottom of the downspout section adjacent the closed end for receiving a downspout. Like the first elongated gutter section, the downspout section similarly includes a screen hingedly attached to a first side and adapted to overlie the opposing side. Moreover, the screen is designed to overlie the received downstream end of the gutter section that is received by the downspout section. In this way, the screen may be pivoted about the hinged attachment to provide an open path to the U-shaped channel. During installation, the downstream end of the gutter section may be lowered through the open path and into the channel of the downspout section. Thereafter, the screen may be pivoted downwardly about the hinge to close and overlie the received gutter section portion.

DESCRIPTION OF THE DRAWINGS

The accompanying drawings incorporated in and forming a part of the specification, illustrate several aspects of the present invention, and together with the description serve to explain the principles of the invention. In the drawings.

Figure 2:
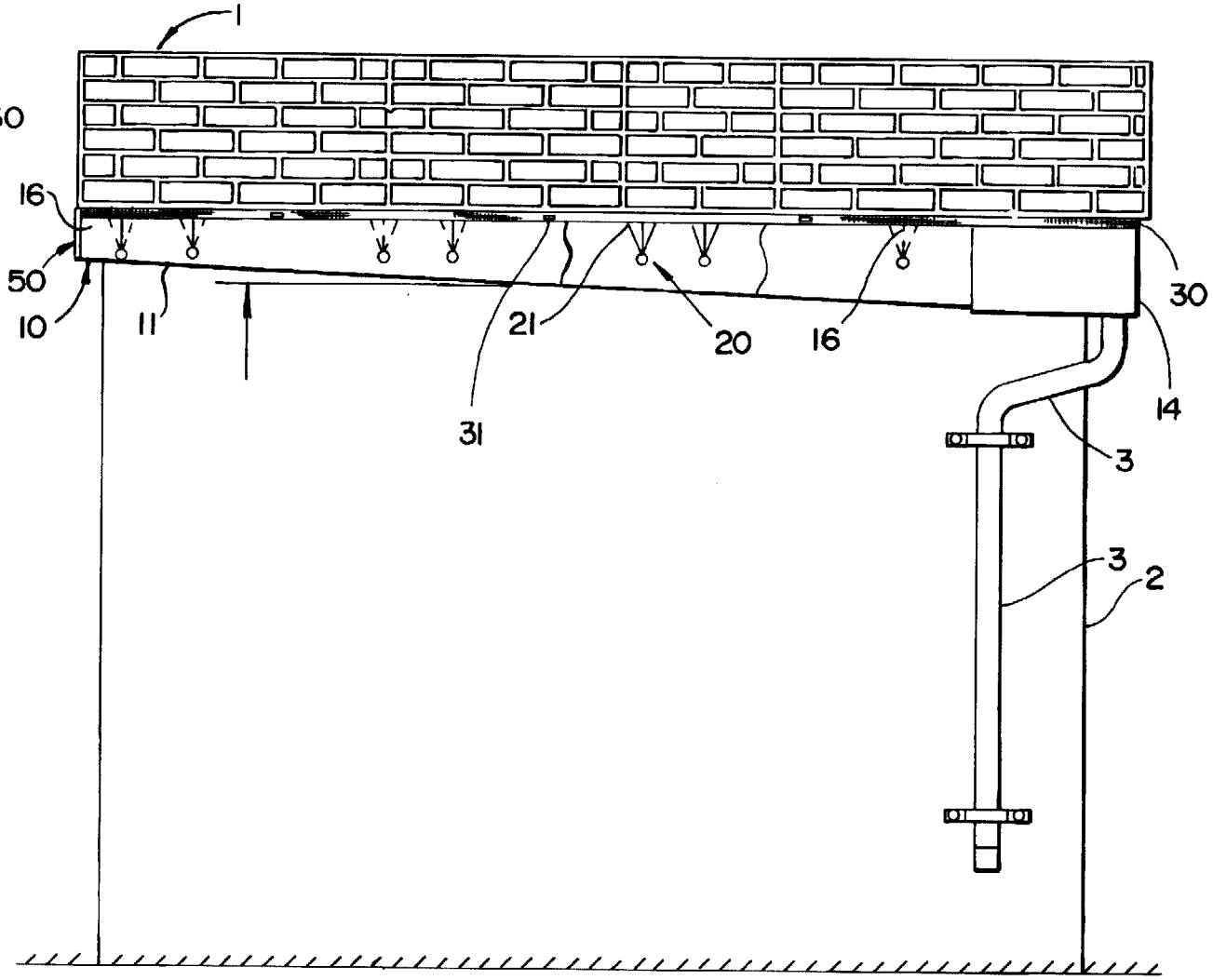
FIG. 2 is a front elevational view of the gutter assembly shown in FIG. 1.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE PREFERRED EMBODIMENT

Figure 1:
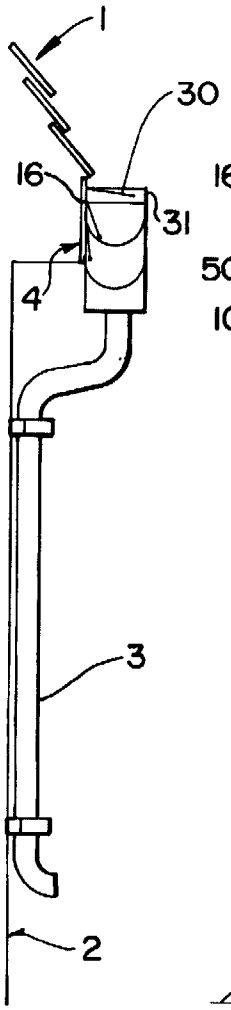
FIG. 1 is a side elevation view of a gutter assembly constructed in accordance with the present invention and positioned on a building structure.

Turning now to the drawings, FIGS. 1–2 illustrate a gutter assembly constructed in accordance with a preferred embodiment of the present invention. More particularly, the gutter assembly generally comprises a gutter section 10 and a downspout section 14. As will be appreciated from the description that follows and consistent with the concepts and teachings of the present invention, the assembly may include more than one gutter section. Multiple gutter sections may be telescopically interconnected in a continuing fashion (see FIG. 9), or alternatively may be joined by way of an intermediately disposed mounting section (see FIGS. 7 and 8). These embodiments will be discussed in more detail below.

Returning now to FIGS. 1 and 2, gutter section 10 is attached to a fascia board 4 by means of screws 16 and 21. In this regard, gutter section 10 is positioned immediately under roof 1 and discharges water through downspout section 14 and out of downspout 3. The gutter section 10 is defined by a bottom 11 and upstanding side walls 12 and 13 to defined a generally U-shaped channel. As can be seen from the drawings, the gutter section 10 is symmetric about a vertical axis. Preferably, the channel is designed to maximize water transport. In this regard, the gutter bottom 11 is arcuately-shaped (in cross section). Flat bottomed gutters have the tendency to retard water flow due to the increased coefficient of friction of the broader surface area.

Figure 4:
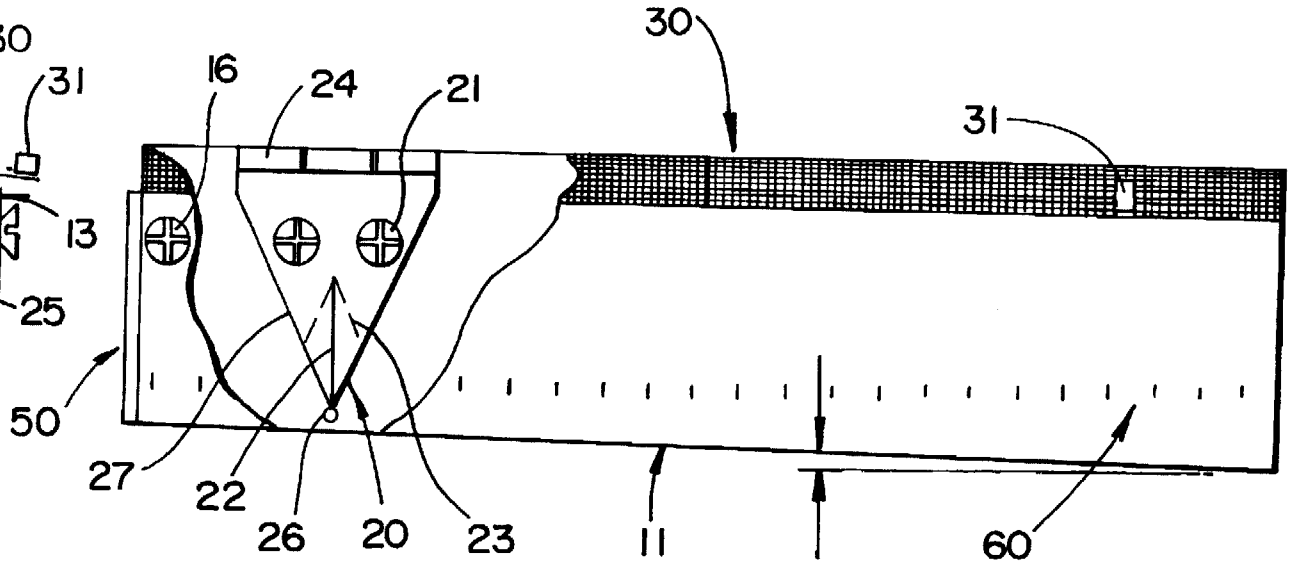
FIG. 4 is a fragmentary elevational view of the gutter assembly shown in FIG. 2.

As best shown in FIGS. 2 and 4, gutter section 10 is pre-sloped along its bottom 11. This built-in decline eliminates the need to slope the gutter assembly itself, ensuring efficient water and debris transport. It also allows for steeper sloping. Since, as previously mentioned, traditional gutters must be installed close to the over-hang of the roof, they cannot be steeply sloped across long spans. This limited sloping further retards water and debris transport and, consequently, generally demands having more downspout openings with corresponding costs.

As shown, the pre-sloping is provided by a tapered gutter section 10. The gutter section 10 may be defined as having an upstream end and a downstream end. The side walls 12 and 13 are progressively tapered from the downstream end to the upstream to define a cross-section of progressively reduced dimension. This structure allows the top edges of side walls 12 and 13 to be mounted adjacent to the roof 1, while still providing a relatively steeply sloped channel for discharging runoff water. By providing a more steeply sloped channel, leveling measurements may be less precise, and therefore installation may be more quickly accomplished.

Figure 3:
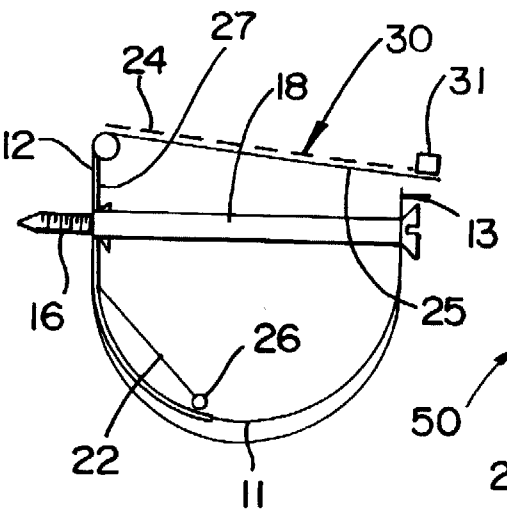
FIG. 3 is a detailed elevational view of the gutter assembly illustrated in FIG. 1 (without the end-cap)

The gutter section 10 is attached to the facia board 4 by means of bracket assemblies 20. As will be described, these bracket assemblies also include means for leveling the gutter section during installation. Reference is now made to FIGS. 3 and 4, which illustrate one of the bracket assemblies 20 in greater detail. The bracket assembly 20 consists of a bracket plate 27 having holes for receiving screws 21. Preferably the gutter section 10 will be pre-sized at the manufacturing site, and corresponding alignment holes will be provided. Alternatively, and still consistent with the scope of the invention, such holes may be drilled by the installer at ground level, before toting the gutter section 10 onto a working ladder or scaffolding. Further still, and depending upon the material comprising the gutter section 10, the corresponding holes may be formed by the penetrating screws 21 as they are advanced into the facia board 4.

As will be discussed in more detail below, the gutter assembly also includes a screen assembly 30, which serves to prevent leaves and other foreign debris from entering the gutter channel and inhibiting the free discharge of runoff water. The screen assembly 30 is hinged (as by a piano hinge) at 24. The screws 21 preferably secure the depending plate of the screen assembly 30 against the sidewall 12 adjacent the facia board 4. In this manner, a single step installation (i.e., installing the mounting brackets 20) serves to both hang the gutter section 10 as well as attach the screen assembly 30.

The brackets assemblies 20 also include means for leveling the gutter section 10. The leveling means comprises a plumb line 22 and weight 26 aligned against markings 23 on bracket plate 27. Preferably, the leveling and bracket assemblies are uniformly spaced along the gutter section in pairs. The two brackets of a given pair are spaced approximately three to four feet apart, or otherwise less than an average arm span. This allows a single installer to attach two bracket assemblies 20 at a single ladder position. The bracket pairs may be spaced apart as appropriate to provide adequate support for the gutter section. This spacing will be determined by a number of factors including the weight and material of the gutter section, the size of the screws 21 used to fasten the bracket assembly 20, the size/strength of the bracket assembly 20, etc.

In the preferred embodiment anchoring screws 16 are utilized to provide added support to the gutter section 10. These anchoring screws will extend through both side walls 12 and 13 and into the facia board 4. An anchoring screw 16 will typically be secured at each end of a gutter section 10. Additional anchoring screws 16 may also be provided in intermediate locations if needed, particularly for lengthy gutter sections 10.

It will be appreciated that the combined leveling and bracket assembly 20 along with the pre-sloping promote the installation of the gutter assembly without the need for a second installer; without the need for a ruler, level and chalk line tools; and without the need to separately install mounting hooks.

Scored markings 60 may be provided along the length of the gutter section 10 to facilitate the measurement of gutter sections, without the need of a ruler or tape measure. In this regard, the markings may be spaced at one inch intervals, for example, wherein every twelfth marking 60 may be enlarged to readily demarcate one foot lengths.

As previously mentioned, a screen assembly 30 may be provided to prevent debris from entering the channel. Preferably, the screen assembly 30 is installed as shown, whereby the hinged side 24 is elevated to define an outwardly-directed, downward slope. This slope advantageously motivates the discharge of debris from the surface of the screen assembly 30. Indeed, leaves and other debris that would otherwise collect on the surface of the screen assembly 30 are urged by gravity to skid or otherwise discharge therefrom. Runoff water from the adjacent roof 1 will serve to serve to further motivate the discharge of debris from the surface of the screen assembly 30.

As previously described, the screen assembly 30 is attached to the side wall 12 of gutter section 10 by the insertion of mounting screws 21 through a depending flange of the screen assembly 30. The distal side of the screen assembly 30, however, is free-standing and merely forms an abutment engagement with the opposite side wall 13. This facilitates the opening of the screen assembly 30, if necessary, to clean any debris that may get into the gutter channel. More importantly, wind flaps 31 are spaced along the outer edge of the screen assembly 30. Wind acting upon the wind flaps 31 cause the screen assembly 30 to vibrate at the abutment engagement, thereby shaking debris off the screen assembly.

Figure 6:
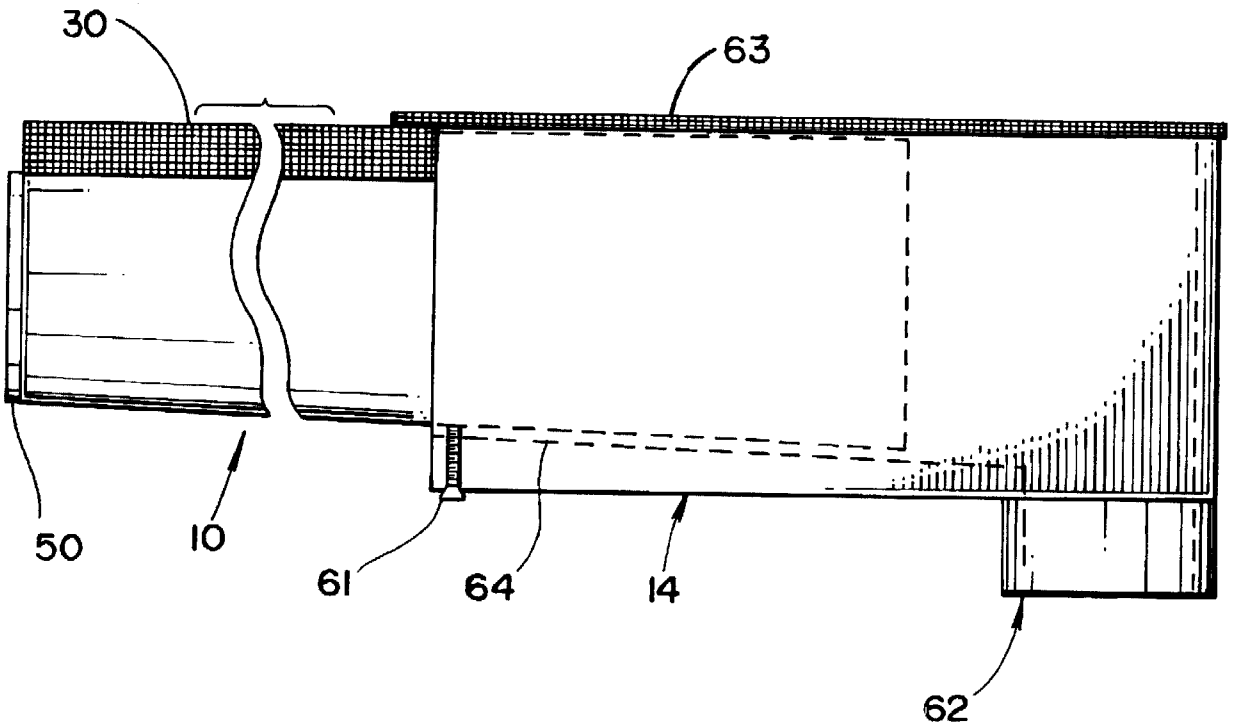
FIG. 6 is a front elevational view of the downspout section shown in FIG. 5.
Figure 5:
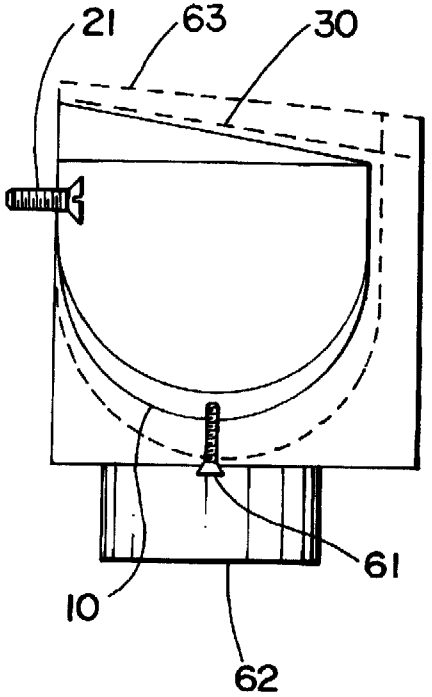
FIG. 5 is a side elevational view of an adaptive downspout section.

Referring now to FIGS. 5 and 6, an end downspout section 14 is shown. Like the gutter section 10, the downspout section 14 has a generally U-shaped cross-section. Further, it is dimensioned slightly larger than the downstream end of the gutter section 10. In this way, the downspout section 14 may telescopically receive the downstream end of the gutter section 10 as shown in FIG. 6. As will be appreciated, the downspout section 14 may be sized to allow considerable telescopic overlap. Desirably, this substantially reduces the need to make precise measurements for sizing the gutter section 10 for a given span of roof.

The downspout section also includes an integral overlying screen 63. Like the screen assembly 30, the screen 63 is preferably hinged at the side adjacent the facia board 4 for pivotal movement between open and closed positions. It is contemplated that the screen 63 will be opened during installation. This will allow the gutter section 10 to be lowered into the channel of the downspout section 14. Thereafter, the screen 63 may be pivoted into the closed position, to overly channel, including that portion of the downstream end of the gutter section that is telescopically received by the downspout section 14.

More particularly, it is contemplated that the installation may be performed by first installing the downspout section 14. Certainly, this is an operation that may be readily accomplished by a single person. Thereafter, the gutter section 10 may be installed. This too may be achieved by a single person. To this end, the installer may first secure the upstream end of the gutter section 10 to the facia board 4. During this step, the downstream end of the gutter section 10 may be placed in the downspout section 14, which will support the downstream end, while the installer installs the various mounting bracket assemblies 20.

An adjustment screw 61 may be provided to variably adjust the vertical displacement of the downstream end from the downspout section 14, and thereby adjust the level (if desired) of the gutter section 10.

In the embodiment illustrated in FIG. 6, the downspout section 14 has a closed end opposite the receiving end, and an opening 62 for receiving a downspout is provided at that end. Although the opening 62 may be offset from the end, it is preferred to provide this opening 62 at the end of the downspout section 14 so that debris that may otherwise accumulate within the gutter does not accumulate on a downstream side. An end-cap 50 may be pre-installed on the upstream end of the gutter section 10 by force fitting.

Figure 9:
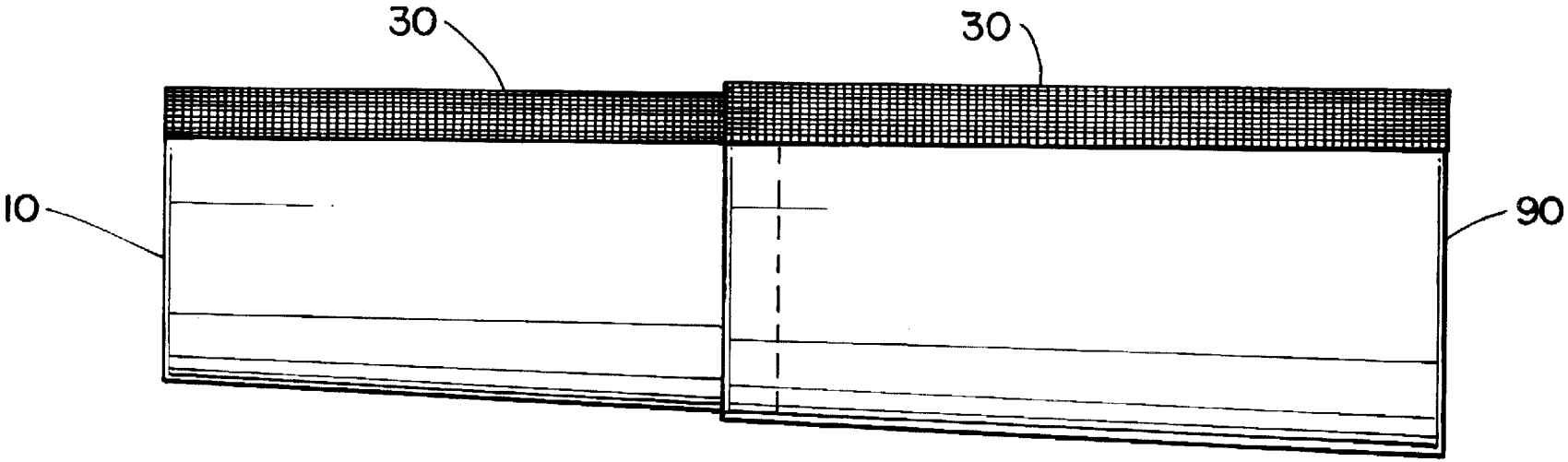
FIG. 9 is front elevational view illustrating telescopically interconnected gutter sections in accordance with the invention.
Figures 10, 11, 12:
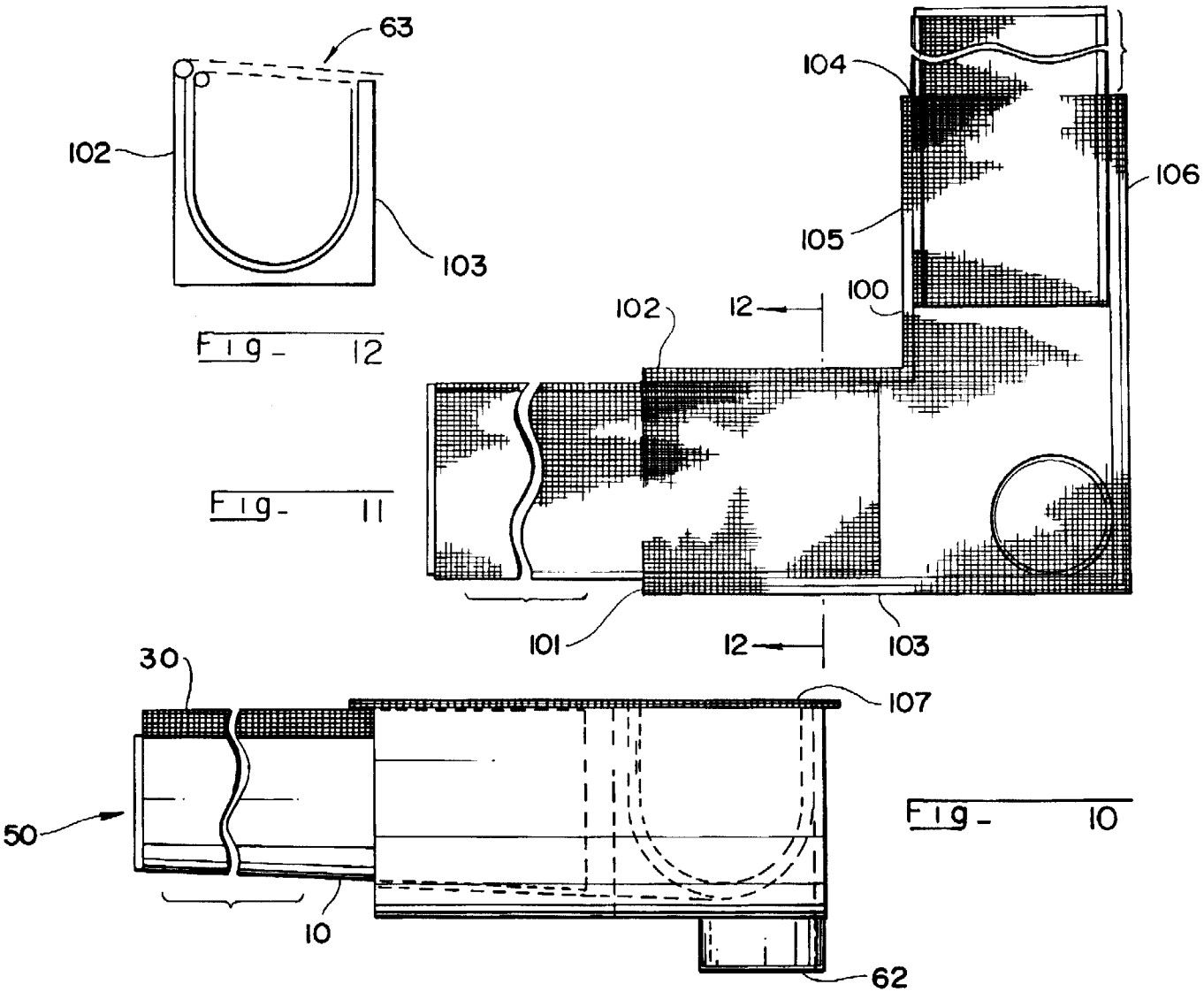
FIG. 10 is a schematic top plan view of a corner downspout section showing two telescopically interconnected gutter sections.
FIG. 11 is a schematic side elevation view of a corner downspout section showing two telescopically interconnected gutter sections.
FIG. 12 is a schematic sectional view of a corner downspout section taken substantially on line 12—12 shown in FIG. 11 of the drawings, and shows a telescopically interconnected gutter section.

Consistent with the concepts and teachings of the present invention, a downspout section shown in FIGS. 9 and 10, will have a first end 101 with a first end first side 102 and a first end second side 103, and a second 104, with a second end first side 105 and a second end second side 106, configured to receive two orthogonally disposed gutter sections. In this regard, the downspout section will be located at a roof corner. A first gutter section will be received in a first end of the downspout section, in the manner previously described. A second, orthogonally disposed gutter section will be received in a second end (orthogonally disposed) of the downspout section, in a similar fashion. A corner downspout screen assembly 107 may be hingedly attached to one or both of the first sides (102, 105) of the downspout, to overlay the corresponding second side of the downspout (103, 106).

Figure 7:
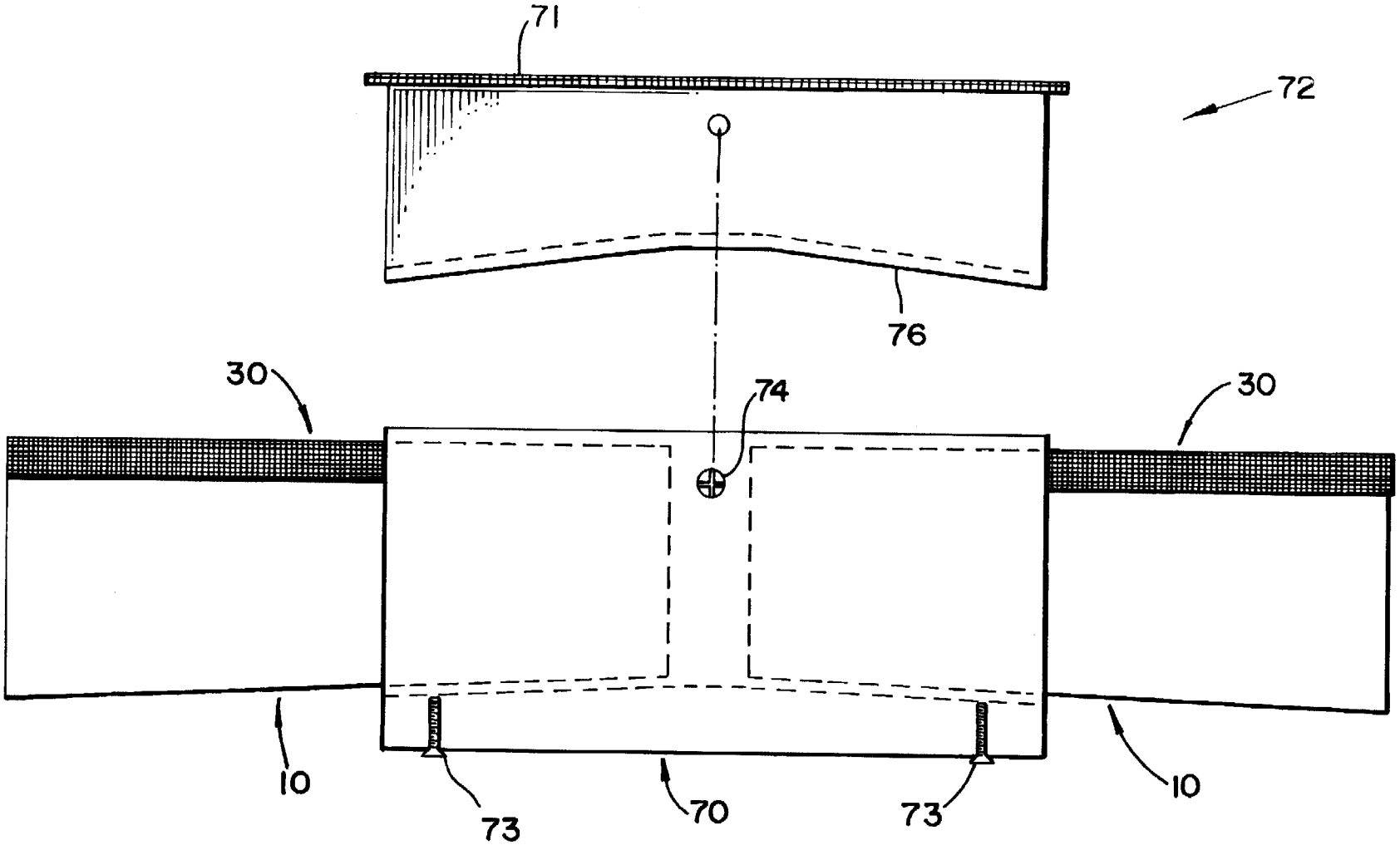
FIG. 7 is an exploded front elevational view of an adaptive central section for interconnecting two consecutive gutter sections.

In yet another embodiment, and consistent with the spirit and scope of the invention, a variable length center mount section 70 may be provided to interconnect consecutive gutter sections 10. This embodiment is illustrated in FIG. 7 (exploded view). As previously mentioned, and illustrated in FIG. 9, consecutive gutter sections 10 may be telescopically interconnected. However, and as shown in FIG. 7, it may be desired to interconnect adjacently disposed upstream end portions of two gutter sections 10. Like the downspout section 14 previously described, the center mount section 70 preferably comprises a central channel that receives the upstream end portion of the gutter sections 10. Adjustment screws 73 may be provided to adjust the vertical displacement of the gutter section 10, for purposes of leveling the gutter sections. As can be seen from the figure, a significant overlap between the gutter sections 10 and the center mount section 70 is provided. This allows for much greater dimensional tolerances when sizing the component parts, and therefore facilitates the installation process.

An overlying screen 71 is also provided to keep debris from entering the channel. In the illustrated embodiment the screen 71 is provided as a part of a drop-in assembly 72. After the gutter sections are disposed within the channel of the center mount section 70, the drop-in section may be lowered into place, whereby the screen 71 overlies the channel and the portions of the gutter sections 10 received in the channel of the center mount section 70. A screw 74 may be used to secure the drop-in section 72 in place. Alternatively, the screen 71 may be hingedly mounted on the back edge of the center mount section 70, much like the overlying screen of the downspout section 14 previously described. In such an embodiment, the screen 71 may simply be flipped up to clear the channel during installation, to provide a clear path for lowering the gutter sections 10 into the channel.

As shown in fantom line, the drop-in section has a bottom 76. Since the center mount section is joining two upstream ends of gutter sections 10, it is important to provide bottom 76 to prevent water leakage. More particularly, runoff water from a roof into the center mount section 70 contacts bottom 76 (which overlies the bottoms of gutter sections 10). Since the bottom 76 is sloped downwardly and away from the center of the center mount section 70, water is carried directely from the drop in section to the gutter sections 10, and no leakage can occur around the seam of gutter sections 10 and the center mount section 70.

Figure 8:
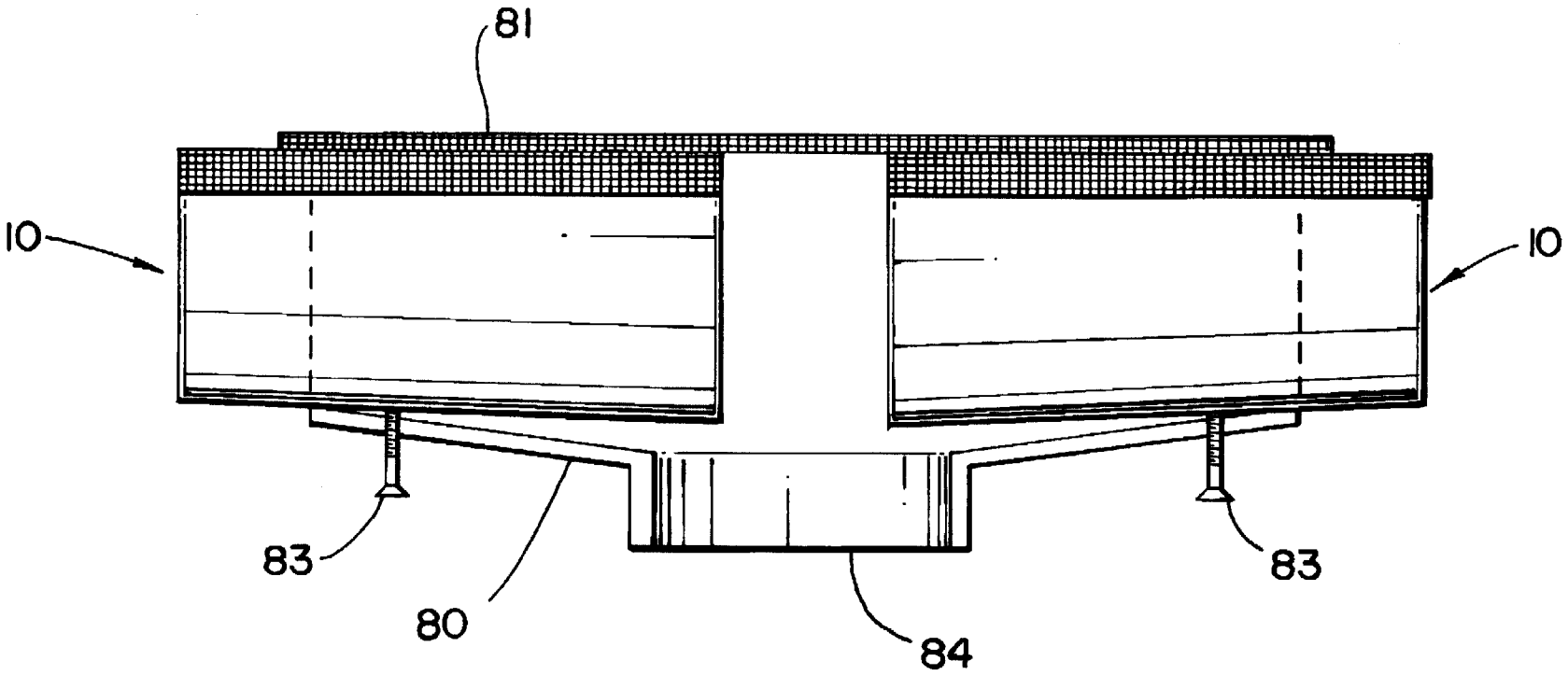
FIG. 8 is a front elevational view of an adaptive central downspout section.

A similar embodiment is illustrated in FIG. 8. In FIG. 8, however, the variable length mounting section 80 includes a centrally disposed hole 84 for receiving a downspout. Accordingly, this mounting section is used to interconnect two downstream ends of consecutively disposed gutter sections 10. Like the mounting section 70 shown in FIG. 7, the mounting section 80 includes a screen 81 that may either be hingedly mounted to the section 80 or may be provided in connection with a drop-in section.

Unlike the mounting section 70 of FIG. 7, however, any drop-in section provided in connection with the mounting section 80 will be of an inverted U-shape. That is, any drop-in section for section 80 will not have a bottom. Since section 80 is interconnecting the downstream ends of two consecutive gutter sections 10, it is important that the water delivered from the sections 10 to the section 80 is not inhibited from reaching the downspout opening 84.

It will be appreciated that the center mounting sections 70 and 80 of FIGS. 7 and 8 may be provided to interconnect gutter sections 10 at a roof corner, as well as interconnecting gutter sections 10 (as shown) at some intermediate point along an edge of a roof.

Referring now to FIG. 9, gutter sections may alternatively be telescopically interconnected. In this regard, a specially sized gutter section 90 may be provided to telescopically receive the downstream end of a gutter section 10. Since the downstream end of a gutter section 10 is larger than the upstream end, it will not be readily received in the channel of an upstream end of a successive gutter section. Therefore, a specially sized gutter section 90 of larger cross-section may be provided.

It will be appreciated by those of skill in the art that the gutter system described herein can be constructed of any commonly used materials including sheet metal, aluminum, plastic or vinyl. The only consideration regarding material is expansion and contraction. The illustrations and descriptions shown herein assume a non-expanding/contracting gutter material such as sheet metal. Appropriate modification, however, for expanding materials will be appreciated by persons skilled in the art.

Described below is the typical process that may be followed by an installer: Gutter section 10 is pre-assembled with upstream end-cap 50, bracket/leveling assemblies 20, wood screws 16 and 21, and gutter screen 30. Placing the ladder approximately 2 feet from the end of the building roof, the installer may carry up the upstream end of said gutter section and place it against the fascia board 4. Wood screw 16 may be partially screwed into end of the fascia board 4. Gutter section 10 may then be held in an approximately level manner. Using the leveling assembly, plumb line 22 is aligned with slope markings 23 to either level or adjust the desired slope. Screws 21 are screwed into the fascia board 4. Screw 16 may then be completely tightened. The leveling plumb line 22 and weight 26 may then be removed. Successively placing the ladder between pairs of bracket assemblies that are 3–4 feet apart, this process is repeated across the entire length of gutter section 10 until either the end of said gutter section is reached or the opposite end of the building structure is reached. If the building structure length exceeds the length of said gutter section, either a variable length center mount assembly 70, variable length downspout opening 80, or gutter connection 90 may be utilized.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A sloped gutter assembly for controlled removal of water from a structure roof comprising:

an elongated gutter section having a bottom and upstanding sidewalls defining a generally U-shaped cross-section, the gutter section having an upstream end and a downstream end, wherein the sidewalls are progressively tapered from the downstream end to the upstream end to define a cross-section of progressively reduced dimension;

a plurality of mounting brackets integrally attached to one of the upstanding sidewalls and including means for attaching the gutter section to the structure; and a screen hingedly attached along one side to one of the upstanding sidewalls and disposed so that an opposite side overlies an opposing sidewall, the screen being downwardly sloped from the one side to the opposite side; and a downspout section being of generally U-shaped cross-section and having a first end telescopically receiving the downstream end of the gutter section and a second, closed end, the downspout section further having a hole near the second end for receiving a downspout, the downspout section further having a screen hingedly attached to a first side and adapted to overly the downstream end of the gutter section and the second side of the downspout section.

2. The sloped gutter assembly as defined in claim 1, wherein the bottom has a substantially arcuate cross-section.

3. The sloped gutter assembly as defined in claim 1, further comprising a means for leveling the gutter section.

4. The sloped gutter assembly as defined in claim 1, wherein the opposite side of the screen overlies and is suspended above the opposing sidewall and loosely contacts the opposing sidewall when subjected to downward force.

5. The sloped gutter assembly as defined in claim 4, wherein the screen further includes a plurality of wind flaps near the opposite side, whereby the wind flaps generate a reactionary force that is operative to vibrate the opposite side of the screen, whereby vibrating action cooperates with the downward slope of the screen to discharge leaves and other debris from the screen.

6. The sloped gutter assembly as defined in claim 1, further including a plurality of marks uniformly spaced longitudinally along the gutter section.

7. The sloped gutter assembly as defined in claim 1, further including an end-cap located at the upstream end of the gutter section and disposed to close the U-shaped cross-section.

8. A sloped gutter assembly for controlled removal of water from a structure roof comprising:

a first elongated gutter section having a bottom and upstanding sidewalls defining a generally U-shaped cross-section, the gutter section having an upstream end and a downstream end, wherein the sidewalls are progressively tapered from the downstream end to the upstream end to define a cross-section of progressively reduced dimension;

a plurality of mounting brackets integrally attached to one of the upstanding sidewalls and including means for attaching the gutter section to the structure; and a screen hingedly attached along one side to one of the upstanding sidewalls and disposed so that an opposite side overlies an opposing sidewall, the screen being downwardly sloped from the one side to the opposite side.

9. The sloped gutter assembly as defined in claim 8, further including a downspout section being of generally U-shaped cross-section and having a first end for telescopically receiving the downstream end of the first gutter section and a second, closed end, the downspout section further having a hole near the second end for receiving a downspout, the downspout section further having a first side and a second side, and a screen hingedly attached to the first side and adapted to overlay the downstream end of the first gutter section and the second side of the downspout section.

10. The sloped gutter assembly as defined in claim 8, further having a second elongated gutter section of substantially the same physical characteristics as the first gutter section, the second gutter section being disposed in mirror-image fashion about a vertical axis in relation to the first gutter section, wherein the downstream end of the first gutter section is proximally disposed with the downstream end of the second gutter section.

11. The sloped gutter assembly as defined in claim 10, further including a central downspout section, the central downspout section being generally of U-shaped cross-section and having a first end telescopically receiving the downstream end of the first gutter section.

12. The sloped gutter assembly as defined in claim 11, wherein the central downspout section further having a second end telescopically receiving the downstream end of the second gutter section.

13. The sloped gutter assembly as defined in claim 12, wherein the central downspout section includes a centrally disposed hole for receiving a downspout.

14. The sloped gutter assembly as defined in claim 13, wherein the central downspout section further includes a first side and a second side, and a screen hingedly attached to the first side of the downspout section and overlaying the the downstream end of the first and second gutter sections and the second side of the downspout section.

15. The sloped gutter assembly as defined in claim 8, further including a corner downspout section being of generally U-shaped cross-section and having a first end telescopically receiving the downstream end of the first gutter section and a second end telescopically receiving the downstream end of a second gutter section, the first and second ends being substantially orthogonally disposed.

16. The sloped gutter assembly as defined in claim 15, the corner downspout section further having a hole near a junction of the first and second ends for receiving a downspout.

17. The sloped gutter assembly as defined in claim 16, the corner downspout section further includes a first side of the first end, a second side of the first end and a first screen hingedly attached to the first side of the first end of the downspout section and overlaying the downstream end of the first gutter section and the second side of the first end of the downspout section.

18. The sloped gutter assembly as defined in claim 17, the corner downspout section further includes a first side of the second end, a second side of the second end and a second screen hingedly attacked to the first side of the second end of the downspout section and overlaying the downstream end of the second gutter section and the second side of the second end of the downspout section.

* * * * *